US006826914B2

(12) United States Patent
Huster et al.

(10) Patent No.: US 6,826,914 B2
(45) Date of Patent: Dec. 7, 2004

(54) TURBOGROUP OF A POWER GENERATING PLANT

(75) Inventors: Josef Huster, Windisch (CH); Susanne Keller, Untersiggenthal (CH); Walter Lobmueller, Goerwihl (DE)

(73) Assignee: Alstom Technology LTD, Baden (CH)

( * ) Notice: Subject to any disclaimer, the term of this patent is extended or adjusted under 35 U.S.C. 154(b) by 9 days.

(21) Appl. No.: 10/218,410

(22) Filed: Aug. 15, 2002

(65) Prior Publication Data

US 2003/0033817 A1 Feb. 20, 2003

Related U.S. Application Data

(60) Provisional application No. 60/312,770, filed on Aug. 17, 2001.

(30) Foreign Application Priority Data

May 7, 2002 (CH) ..... 0781/02

(51) Int. Cl.[7] ..... F02C 7/20

(52) U.S. Cl. ..... 60/797; 248/639; 415/213.1

(58) Field of Search ..... 60/796, 797, 805; 248/637, 639; 415/213.1, 229

(56) References Cited

U.S. PATENT DOCUMENTS 4,331,366 A 5/1982 Dömer et al.
4,438,339 A * 3/1984 McHugh ..... 290/1 R
4,961,310 A * 10/1990 Moore et al. ..... 60/797
5,201,796 A 4/1993 Glinski et al.
5,271,217 A * 12/1993 Knuijt ..... 60/797
5,447,025 A 9/1995 Rousselle
5,780,932 A * 7/1998 Laffont ..... 60/797

FOREIGN PATENT DOCUMENTS

| | | |
|---|---|---|
| CH | 214978 | 5/1941 |
| CH | 610983 | 5/1979 |
| CH | 614029 | 10/1979 |
| DE | 2361971 | 5/1975 |
| DE | 2532456 | 1/1977 |
| DE | 19600419 | 7/1997 |
| GB | 643848 | 9/1950 |

* cited by examiner

*Primary Examiner*—Louis J. Casaregola
(74) *Attorney, Agent, or Firm*—Burns, Doane, Swecker & Mathis, L.L.P.

(57) ABSTRACT

The present invention relates to a turbogroup (1) of a power generating plant. A turbine unit (2), has a turbine (4) and a further fluid-flow machine (6) on a common turbine shaft. A generator unit (3), has a generator (8) on a generator shaft (9). The turbine shaft (5) and the generator shaft (9) are connected to one another. A third radial bearing unit (13) supports the generator shaft (9) on a side of the generator (8) which faces the turbine unit (2). A thrust bearing unit (16) supports the turbine shaft (5) axially between the generator (8) and the additional fluid-flow machine (6). The thrust bearing unit (16) and the third radial bearing unit (13) are integrated in a common bearing block (17) which is firmly connected to a fixed foundation (18).

7 Claims, 2 Drawing Sheets

TURBOGROUP OF A POWER GENERATING PLANT

This application claims the benefit of Provisional application No. 60/312,770 filed on Aug. 17, 2001.

TECHNICAL FIELD

The invention relates to a turbogroup of a power generating plant, in particular a gas-storage power plant, comprising a turbine unit and a generator unit.

BACKGROUND OF THE INVENTION

A turbine unit normally has a turbine and a further fluid-flow machine on a common turbine shaft. In a conventional power generating plant, this further fluid-flow machine may be formed by a compressor which is driven by the turbine via the turbine shaft. In a gas-storage power plant, in particular an air-storage power plant, this further fluid-flow machine is formed by an additional turbine, to which the gas of a gas reservoir of the gas-storage power plant is admitted, so that the additional turbine likewise transmits drive output to the turbine shaft. As a rule, a generator unit has a rotor of a generator on a generator shaft and serves to generate electricity. The turbine unit serves to drive the generator unit, so that accordingly the turbine shaft is in drive connection with the generator shaft.

During operation of the turbogroup, relatively large masses rotate at relatively high speeds. In order to be able to control the dynamic vibration behavior of the turbogroup, in particular of the turbine unit, a high-capacity bearing system is necessary. Such a bearing system normally comprises at least four radial bearing units, with which the shafts are radially mounted and at least supported at the bottom, and at least one thrust bearing unit, which normally absorbs the thrust of the turbine, or possibly of the turbines, in the axial direction at the turbine shaft. For this purpose, a first radial bearing unit is arranged on a side of the turbine which faces away from the generator unit, whereas a second radial bearing unit is arranged on a side of the further fluid-flow machine which faces the generator unit. A third radial bearing unit is arranged on a side of the generator which faces the turbine unit, and a fourth radial bearing unit is arranged on a side of the generator which faces away from the turbine unit. In this case, the thrust bearing is expediently arranged axially between the generator and the further fluid-flow machine of the turbine unit. It is possible here in principle to arrange the thrust bearing unit next to the second radial bearing unit. If the further fluid-flow machine is a compressor, the thrust bearing unit can be integrated in an air-feed casing which serves to feed air to the compressor.

Thrust bearings work optimally when the bearing axis runs coaxially to the rotation axis of the shaft to be supported. Thrust bearings react in a sensitive manner to changes in inclination and misalignments; in particular, friction, the generation of heat, and wear increase. If the turbine unit has an annular combustion chamber for firing the turbine and if the further fluid-flow machine of the turbine unit is formed by a compressor, the changes occurring during operation in the relative position between the bearing axis of the thrust bearing unit and the rotation axis of the turbine are relatively small. However, if a combustion chamber lying at the top, a "silo combustion chamber", is used instead of an annular combustion chamber, temperature differences in the outer casing of the turbine unit from top to bottom cannot be ruled out. This different temperature distribution in the outer casing may lead to the outer casing arching convexly upward—"banana formation". While the casing bends, the rotation axis of the turbine shaft remains invariable. Since the thrust bearing unit is normally integrated in the casing of the turbine unit next to the second radial bearing unit, the relative position between the bearing axis of the bearing unit fixed to the casing and the rotation axis of the turbine shaft may change to a relatively pronounced degree due to the asymmetrical thermal expansion of the casing, as a result of which a proper thrust bearing arrangement is put at risk.

If the turbogroup is now to be used in a gas-storage power plant, the further fluid-flow machine used is an additional turbine instead of the compressor. Such an additional turbine has a radial gas feed with optional additional gas inlets or gas discharges compared with the conventional compressors. Accordingly, the thermal expansion effects referred to appear to a greater extent, as a result of which the loading of the thrust bearing unit in particular additionally increases. Furthermore, such an additional turbine inside a gas-storage power plant works on the inlet side with considerably higher pressures and temperatures in the fed gas flow than a conventional compressor. This may also intensify the thermal expansion effects. At the same time, the outlay for the oil supply to the thrust bearing unit increases considerably on account of a large axial thrust.

During operation of the turbogroup, the radial bearing units and the thrust bearing unit absorb not only inertia forces or thrust forces but also vibrations which are caused, for example, by out-of-balance of the rotating masses. In this case, both the turbine unit and its bearing system in each case form vibratory systems which are coupled to one another and have natural frequencies or resonant frequencies. For reliable operation of the turbogroup, it is necessary that natural vibrations in the turbine unit and in the bearing system do not occur within an attenuation range of the turbine-shaft operating speeds which extends, for example, from −10% to +15% of the rated operating speed of the turbine shaft. On account of the highly complex coupling of the vibration systems and on account of a multiplicity of boundary conditions which cannot be determined exactly, it is presently not possible to be able to predict the vibration behavior of the turbine unit and of the associated bearing system in a sufficiently reliable manner at a justifiable cost. Measures are therefore sought which make it simpler or make it possible to subsequently influence the vibration system. Of particular interest in this case are measures which involve minimum interference with the design and the construction of the turbine unit.

SUMMARY OF THE INVENTION

The invention is intended to provide a remedy here. The invention, as characterized in the claims, deals with the problem of showing how, for a turbogroup of the type mentioned at the beginning, to make it possible or easier to influence the vibration behavior of the turbine unit and/or of the bearing system.

This problem is achieved according to the invention by the subject matter of the independent claim. Advantageous embodiments are the subject matter of the dependent claims.

The present invention is based on the general idea of integrating the thrust bearing unit together with the third radial bearing unit in a common bearing block, this common bearing block being firmly attached to a foundation. Due to this measure, the axial support of the turbine shaft is effected in the region of the third radial bearing unit, which is actually assigned to the generator. This means that, in this type of construction, the axial support of the turbine shaft is separated from the fluid-flow machines of the turbine group or is effected at a distance therefrom in the region of the generator unit. The result of this type of construction is that the second radial bearing unit is spatially uncoupled from the thrust bearing unit, as a result of which measures for influencing the vibration characteristic of the turbine unit or of the bearing system of the turbine unit can be carried out in a simpler manner just on account of better accessibility. For example, the radial bearing units, in particular the second radial bearing unit, provided for the bearing arrangement of the turbine unit, can be influenced with corresponding damping means.

In addition, the proposed type of construction makes it possible for the turbine unit to be compact in the axial direction, since the bearing system in the region of the second radial bearing unit is of markedly smaller construction than in conventional turbogroups. Furthermore, the oil supply and the instrumentation for the thrust bearing unit are simplified, since the latter, according to the invention, is not accommodated in the casing of the further fluid-flow machine or in the casing of the turbine unit but outside it.

In an expedient embodiment of the turbogroup, the first radial bearing unit and/or the second radial bearing unit may have pendulum supports which are in each case supported on a bearing pedestal. A particular development is based on the general idea of supporting the pendulum supports, at least at one radial bearing unit of the turbine unit, on the associated bearing pedestal in each case via a spring element. Such a spring element changes the vibration properties of the respective radial bearing unit and thus of the entire vibration system coupled thereto. By suitable selection of this spring element, the desired tuning of the entire vibratory system can be carried out to the effect that the critical natural frequencies are clearly outside the attenuation range for the operating speeds of the turbine shaft. In this case, it is perfectly possible to adapt the spring element by the "trial-and-error principle", since this selection of the suitable spring elements for the respective turbogroup type need only be made once before the initial commissioning of the first turbogroup of a new series. The spring element configuration found once may then be adopted for all subsequent models of this type.

According to an especially advantageous development, the bearing pedestal may have a top side extending essentially in a planar manner, the spring element then being formed by a metal plate which extends essentially parallel to the bearing pedestal top side, carries centrally on its top side the associated pendulum support and is supported on the bearing pedestal off-center on its underside via distance elements in such a way that a distance is formed between bearing pedestal top side and metal plate. Vibrations can be induced in the metal plate perpendicularly to its plane, this metal plate being at a distance from the bearing pedestal top side. The spring characteristic of this metal plate can be influenced by the selection of the distance elements used in each case. The limits of the vibratory range of the metal plate are defined on the metal plate via the distance elements, since the metal plate is supported on the bearing pedestal via the distance elements. The distance elements can be varied, for example, with regard to their dimensions parallel to the plane of the metal plate and/or with regard to their material and/or with regard to their number and/or with regard to their outer contour. It is likewise possible to provide stiffeners on the metal plate, in particular on its top side, these stiffeners likewise influencing the vibration behavior of the metal plate. The optimum spring characteristic of the metal plate can be determined relatively simply by test runs. As soon as a sufficiently favorable vibration behavior is set for the entire system, the distance elements, only temporarily attached for the tests, are finally fastened, e.g. welded, to the bearing pedestal and to the metal plate.

The embodiments of the turbogroup which are proposed according to the invention are especially suitable for use in a gas-storage power plant, the further fluid-flow machine then being formed by an additional turbine. Since the thrust bearing unit is formed together with the third radial bearing unit in a common bearing block, the thrust bearing unit is located outside the additional turbine, so that the thermal expansion effects of the turbine unit do not affect the thrust bearing unit or only affect it slightly.

Further important features and advantages of the turbogroup according to the invention can be taken from the subclaims, the drawings and from the associated description of the figures with reference to the drawings.

DETAILED DESCRIPTION OF THE INVENTION

Figure 1:
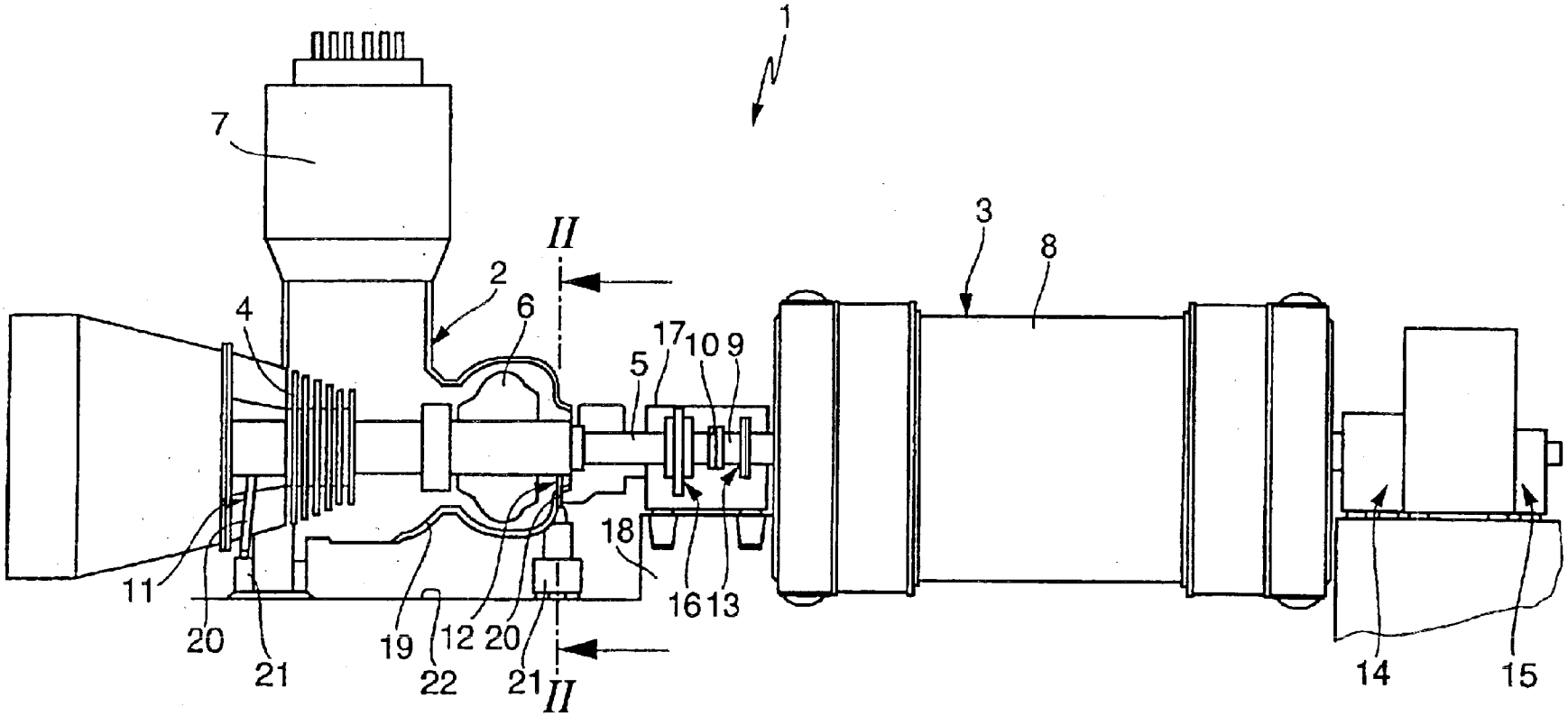
FIG. 1 shows a highly simplified axial section through a turbogroup according to the invention.

In accordance with FIG. 1, a turbogroup 1 according to the invention of a power generating plant (otherwise not shown) comprises a turbine unit 2 and a generator unit 3. The turbine unit 2 has a turbine 4, the rotor of which is connected to a turbine shaft 5 in a rotationally fixed manner. In addition, this turbine shaft 5 carries the rotor of a further fluid-flow machine 6. This further fluid-flow machine 6, in a conventional power generating plant, may be a compressor which produces compressed gas or compressed air for the turbine 4. If the power generating plant is a gas-storage power plant, in particular an air-storage power plant, the further fluid-flow machine 6 is designed as an additional turbine to which the gas stored in a gas reservoir of the gas-storage power plant is admitted. Gas-storage power plants are gaining increasing importance, in particular within a "Compressed-Air-Energy-Storage System", in short a CAES system. The basic idea of a CAES system is seen in the fact that excess energy which is generated by permanently operated conventional power generating plants during the base-load times is transferred to the peak-load times by bringing gas-storage power plants onto load in order to thereby use up fewer resources overall for producing the electrical energy. This is achieved by air or another gas being pumped under a relatively high pressure into a reservoir by means of the excess energy, from which reservoir the air or gas can be extracted when required for generating electricity. This means that the energy is stored in a retrievable manner in the form of potential energy. Worked-out coal or salt mines, for example, serve as reservoirs.

In addition, the turbine unit 2 has a combustion chamber 7 (silo combustion chamber) at the top, which produces hot combustion exhaust gases in a conventional manner, these combustion exhaust gases being fed to the inlet side of the turbine 4. The turbine 4 and the additional fluid-flow machine 6 are expediently accommodated in a common casing 19, to which the combustion chamber 7 is also attached.

The generator unit 3 has a generator 8, the rotor of which is connected to a generator shaft 9 in a rotationally fixed manner. The generator shaft 9 is in drive connection with the turbine shaft 5 by means of a suitable coupling unit 10. During operation of the turbogroup 1, the turbine 4 drives the turbine shaft 5. If the additional fluid-flow machine 6 is an additional turbine, it likewise helps to drive the turbine shaft 5 when compressed air is admitted. The turbine shaft 5 drives the generator shaft 9 via the coupling unit 10, as a result of which electric current is generated in the generator 8.

To support the shafts 5 and 9, the turbogroup 1 has several, here five, radial bearing units 11, 12, 13, 14, 15 and a thrust bearing unit 16. The first radial bearing unit 11 and the second radial bearing unit 12 are assigned to the turbine unit 2 and serve to support the turbine shaft 5. For this purpose, the first radial bearing unit 11 is arranged on a side of the turbine 4 which faces away from the generator unit 3 and is shown on the left according to FIG. 1. The second radial bearing unit 12 is arranged on a side of the additional fluid-flow machine 6 which faces the generator unit 3 and is thus shown on the right according to FIG. 1.

The third radial bearing unit 13 and the fourth radial bearing unit 14 are assigned to the generator unit 3 and serve to support the generator shaft 9. The third radial bearing unit 13 is arranged on a side of the generator 8 which faces the turbine unit 2 and is shown on the left in FIG. 1, whereas the fourth radial bearing unit 14 and the fifth radial bearing unit 15 are arranged on a side of the generator 8 which faces away from the turbine unit 2 and is shown on the right in FIG. 1.

The thrust bearing unit 16 is arranged axially between the generator 8 and the additional fluid-flow machine 6 and supports the turbine shaft 5 in the axial direction in order to thus absorb the thrust of the turbine 4 and, if need be, of the additional fluid-flow machine 6. According to the invention, the thrust bearing unit 16 and the third radial bearing unit 13 are integrally formed in a common bearing block 17. This bearing block 17 is firmly anchored in a fixed foundation 18, so that the forces transmitted from the turbine shaft 5 to the thrust bearing 16 are transmitted via the bearing block 17 into the foundation 18. In addition, the coupling unit 10 is arranged inside the bearing block 17, this coupling unit 10 being arranged axially between the thrust bearing unit 16 and the third radial bearing unit 13.

If the additional fluid-flow machine 6 is an additional turbine, it is already designed for higher gas pressures on the inlet side and is therefore dimensioned to be more sturdy overall. By the proposed type of construction according to the invention, this type of construction integrating the thrust bearing unit 16 in the bearing block 17 of the third radial bearing unit 13, the thrust bearing unit 16 is arranged at a distance from the additional turbine 6 in the axial direction. As a result, the thrust bearing unit 16 may also be arranged outside the casing 19, so that the temperature transients occurring in the casing 19 have no effect or only a slight effect on the thrust bearing unit 16. Accordingly, a temperature-induced deformation of the casing 19 cannot influence the bearing axis of the thrust bearing unit 16, so that the latter always runs coaxially to the rotation axis of the turbine shaft 5.

In the embodiment shown here, the radial bearing units 11 and 12 assigned to the turbine unit 2 are each designed as a "pendulum-support bearing arrangement". Accordingly, the first radial bearing unit 11 and the second radial bearing unit 12 have at least one pendulum support 20 on each longitudinal side of the turbine unit 2, each pendulum support 20 being supported on a bearing pedestal 21, which in turn is supported on a fixed base or foundation 22. By means of the radial bearing units 11 and 12 designed in such a way, the turbine shaft 5, in particular the complete turbine unit 2, can perform longitudinal movements parallel to the turbine shaft axis, the movement being stabilized by lateral guide elements (not described in any more detail). In conventional turbogroups 1, the use of pendulum-support bearings for the first radial bearing unit 11 is known, so the pendulum-support bearing arrangement need not be explained in more detail. However, a special feature is seen in the fact that, here, the second radial bearing unit 12 is also designed as a pendulum-support bearing arrangement, the construction of which, however, may be similar to a conventional pendulum-support bearing arrangement.

Figure 2:
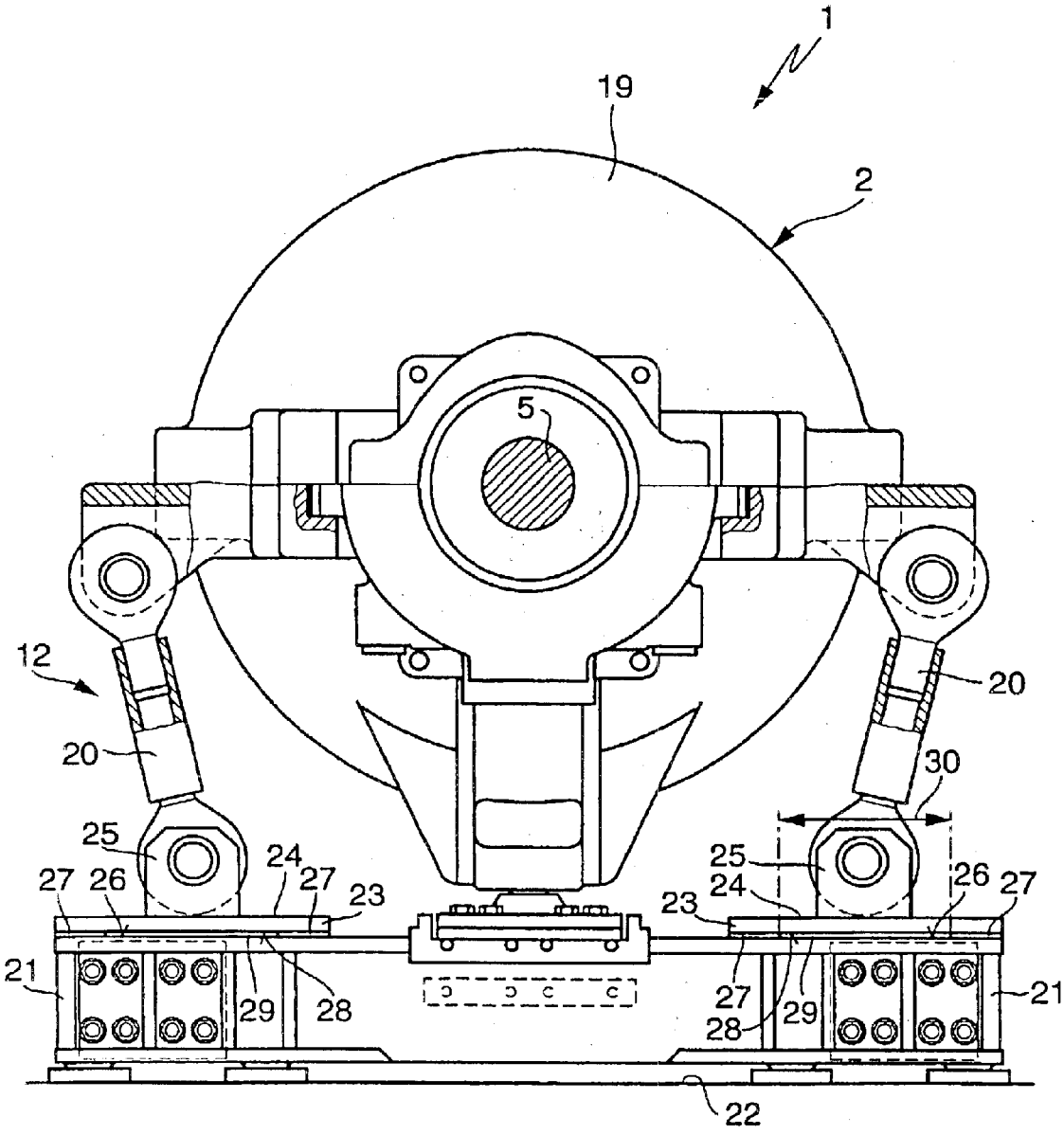
FIG. 2 shows a cross section through the turbogroup according to FIG. 1 along section line II—II.

A special embodiment of such a pendulum-support bearing arrangement is explained in FIG. 2 with reference to the second radial bearing unit 12. It is clear that, in principle, each pendulum-support bearing arrangement, that is to say in particular also the first radial bearing unit 11, can be constructed in the manner explained below. In accordance with FIG. 2, the pendulum supports 20 are not directly supported on the bearing pedestal 21 but indirectly via a metal plate 23. The metal plate 23 is of roughly planar design and has centrally on its top side 24 a holder 25 which is firmly connected thereto, in particular welded thereto, and on which the respective pendulum support 20 is mounted. Accordingly, the pendulum supports 20 are supported centrally on the metal plate 23 on the top side 24 of the latter.

The bearing pedestal 21, which carries the respective metal plate 23, has a top side 26 which extends in a planar manner and on which the metal plate 23 is supported via distance elements 27. In this case, the metal plate 23 and the pedestal top side 26 are oriented parallel to one another. The metal plate 23 and the pedestal top side 26 preferably run essentially horizontally, that is to say parallel to the base or foundation 22. It is of particular importance in this case that the distance elements 27 are arranged off-center on an underside 28 of the metal plate 23. An off-center arrangement in this case denotes an arrangement remote from the plate center, in particular along or at the outer margin of the metal plate 23. By means of the distance elements 27, a gap or distance 29, in particular a vertical gap or distance 29, can be produced between the pedestal top side 26 and the plate underside 28, this gap or distance 29 permitting slight relative movements between the plate center and the pedestal 21. As a result, the metal plate 23 supported on the bearing pedestal 21 forms a spring element in which vibrations can be induced via the respective pendulum support 20. However, the spring characteristic of the metal plate 23 influences the vibration behavior of the entire turbine unit 2. Accordingly, the vibration behavior of the turbine unit 2 can be specifically varied or set by varying the spring characteristic of the metal plate 23.

The spring characteristic of the metal plate 23 can be varied in an especially simple manner by different distance elements 27 being used for supporting the metal plate 23 on the bearing pedestal 21. For example, the distance elements 27 may differ from one another in their extent parallel to the metal plate 23. In this way, for example, a distance 30 between opposite distance elements 27 can be varied, as a result of which virtually the length of the vibratory section of the metal plate 23, that is to say the length of the spring element, can be set in an especially distinct manner. Furthermore, there are a number of possible variations with regard to the arrangement and/or the number of distance elements 27. Likewise, the distance elements 27 can be configured differently with regard to their shape and/or material selection and/or thickness.

By appropriate tests, an optimum spring characteristic for the metal plate 23 can be found by trying out various distance elements 27, and this optimum spring characteristic ensures that, within an attenuation range of the operating speed of the turbine shaft 5, no natural frequencies or resonant frequencies occur in the turbine unit 2 or in the associated bearing unit 11 or 12. As soon as the optimum configuration for the distance elements 27 has been found, the distance elements 27 can be firmly connected, in particular welded, to both the bearing pedestal 21 and the metal plate 23. Further measures for influencing the spring characteristic of the metal plate 23 may also be seen in the configuration of the holder 25. For example, the holder 25 may be supported with an additional angle on the plate top side 24, as a result of which the elasticity and thus the spring characteristic of the metal plate 23 changes.

The indirect support of the pendulum supports 20 via a spring element (metal plate 23) on the bearing pedestal 21 therefore simplifies the tuning of the vibration behavior of the turbine shaft 2 and its bearing arrangement, a factor which is always advantageous when a new type of turbine unit is created, for example when an additional turbine is mounted on the turbine shaft 5 instead of a compressor. In this case, the outlay required for this is limited. Especially advantageous in this case is the physical separation of the thrust bearing unit 16 from the second radial bearing unit 12, this separation making it simpler or first making it possible to influence the second radial bearing unit 12, in particular its spring elements 23.

LIST OF DESIGNATIONS

1 Turbogroup
2 Turbine unit
3 Generator unit
4 Turbine
5 Turbine shaft
6 Fluid-flow machine/additional turbine
7 Combustion chamber
8 Generator
9 Generator shaft
10 Coupling unit
11 First radial bearing unit
12 Second radial bearing unit
13 Third radial bearing unit
14 Fourth radial bearing unit
15 Fifth radial bearing unit
16 Thrust bearing unit
17 Bearing block
18 Foundation
19 Casing
20 Pendulum support
21 Bearing pedestal
22 Base/foundation
23 Metal plate
24 Top side of 23
25 Holder
26 Top side of 21
27 Distance element
28 Underside of 23
29 Distance/gap
30 Distance between two distance elements/spring length of 23

What is claimed is:

1. A turbogroup of a power generating plant, having the following features:

A: the turbogroup comprises a turbine unit which has at least one turbine and a further fluid-flow machine on a common turbine shaft, B: the turbogroup comprises a generator unit which has at least one generator on a generator shaft, C: the turbine shaft and the generator shaft are in drive connection with one another, D: a first radial bearing unit supports the turbine shaft on a side of the turbine which faces away from the generator unit, E: a second radial bearing unit supports the turbine shaft on a side of the further fluid-flow machine which faces the generator unit, F: a third radial bearing unit supports the generator shaft on a side of the generator which faces the turbine unit, G: a fourth radial bearing unit supports the generator shaft on a side of the generator which faces away from the turbine unit, H: a thrust bearing unit supports the turbine shaft axially between the generator and the further fluid-flow machine, I: the thrust bearing unit and the third radial bearing unit are integrated in a common bearing block which is firmly connected to a fixed foundation.

2. The turbogroup as claimed in claim 1, wherein the first radial bearing unit and/or the second radial bearing unit have/has pendulum supports which are in each case supported on a bearing pedestal, and wherein at least one of the pendulum supports is supported on the associated bearing pedestal via a spring element.

3. The turbogroup as claimed in claim 2, wherein the bearing pedestal has a top side extending essentially in a planar manner, and wherein the spring element is formed by a metal plate which extends essentially parallel to the pedestal top side, carries centrally on its top side the associated pendulum support and is supported on the bearing pedestal off-center on its underside via distance elements in such a way that a distance is formed between pedestal top side and plate underside.

4. The turbogroup as claimed in claim 3, wherein the pedestal top side extends essentially horizontally.

5. The turbogroup as claimed in claim 1, wherein a coupling unit which connects the turbine shaft to the generator shaft is arranged in the common bearing block of the third radial bearing unit and the thrust bearing unit.

6. The turbogroup as claimed in claim 1, wherein the turbine unit has a combustion chamber at the top.

7. The turbogroup as claimed in claim 1, wherein said turbogroup is part of a gas storage power plant and the further fluid-flow machine being formed by an additional turbine.

* * * * *